United States Patent [19]

Tanaka et al.

[11] 4,329,615

[45] May 11, 1982

[54] SPARK PLUG FOR INTERNAL COMBUSTION ENGINES

[75] Inventors: Akira Tanaka; Tadashi Hattori; Minoru Nishida, all of Okazaki, Japan

[73] Assignee: Nippon Soken, Inc., Nishio, Japan

[21] Appl. No.: 146,248

[22] Filed: May 5, 1980

[30] Foreign Application Priority Data

Jun. 11, 1979 [JP] Japan ..... 54/73659

[51] Int. Cl.[3] ..... H01T 13/20

[52] U.S. Cl. ..... 313/141; 313/139

[58] Field of Search ..... 313/139–142; 123/169 EL

[56] References Cited

U.S. PATENT DOCUMENTS 4,101,797 7/1978 Yamamoto et al. ..... 313/141

*Primary Examiner*—Eugene R. LaRoche

*Attorney, Agent, or Firm*—Cushman, Darby & Cushman

[57] ABSTRACT

A spark plug for internal combustion engines includes a center electrode, a ground electrode which is bent so that its end portion opposes the forward end face of the center electrode, supporting means for exposing the electrodes into the combustion chamber of an engine, and a cut portion formed on one side of the center electrode end face opposing the ground electrode bend.

16 Claims, 33 Drawing Figures

SPARK PLUG FOR INTERNAL COMBUSTION ENGINES

BACKGROUND OF THE INVENTION

The present invention relates to spark plugs for use in automotive vehicles, and more particularly the invention relates to an improved spark plug having a specially shaped center electrode discharging face for controlling the path of discharge so as to ensure improved ignition performance.

In a known type of spark plug in which a center electrode and a ground electrode have their parallel plane surfaces disposed to oppose each other, when the high voltage produced by an ignition coil of the current interruption type is applied to the center electrode to produce an electric discharge, the discharge tends to start at its edge portion and consequently the path for the discharge to develop and travel tends to be directed from the edge portion (the side) of the center electrode toward the ground electrode. Also the location of discharge at the edge portion irregularly changes each time. As a result, the manner in which the air-fuel mixture is ignited and the resulting flame spreads varies in dependence on the path of discharge.

Under unfavorable conditions, such as, at low engine temperatures, low engine speeds, retarded ignition timing or the like where the mixture is not atomized satisfactorily and the flow velocity of the mixture is low, even if the mixture is ignited, the flame will be extinguished midway due to the obstruction and cooling by the ground electrode. In other words, under varying combustion conditions and unfavorable engine conditions, the engine will cause misfire and also deteriorated engine feeling and heat-melting loss of the exhaust emission controlling catalyst will be caused. Another type of spark plug is known in the art in which the ground electrode is formed with a U-shaped groove in the lengthwise direction, and this known spark plug has the similar deficiencies due to the cooling effect in the lengthwise direction of the ground electrode.

SUMMARY OF THE INVENTION

With a view to overcoming the foregoing deficiencies in the prior art, it is the object of the present invention to provide a spark plug in which the forward end of a center electrode is shaped differently from that of the prior art plug so as to control the location of discharge and thereby to improve the ignition performance on the whole and reduce variation in the manner of flame propagation or variation in the combustion due to the location of discharge.

DESCRIPTION OF THE PRIOR ART

Figure 1A:
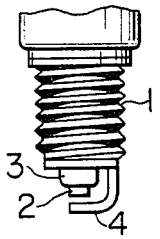
FIG. 1A PRIOR ART
FIG. 1A is a side view showing a principal part of a prior art spark plug.
Figure 1B:
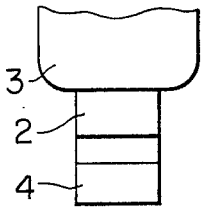
FIG. 1B PRIOR ART
FIG. 1B is an enlarged front view of the principal part of the spark plug of FIG. 1A.
Figure 1C:
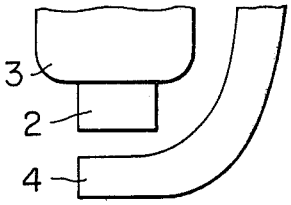
FIG. 1C PRIOR ART
FIG. 1C is a right side view of the principal part of the prior art spark plug of FIG. 1B.

A type of spark plug known in the prior art is shown in FIGS. 1A, 1B and 1C. In the Figures, the known spark plug comprises a metal plug shell or body 1, an insulator 3 secured to the plug shell 1 by means of a packing which is not shown, a center electrode 2 enclosed by the insulator 3 and insulated from the plug shell 1 and a ground electrode 4 fixedly secured to the end of the plug shell 1 so as to be grounded through the plug body, and the center electrode 2 and the ground electrode 4 have their parallel plane surfaces arranged to oppose each other and thereby to provide a discharge gap.

Figure 2:
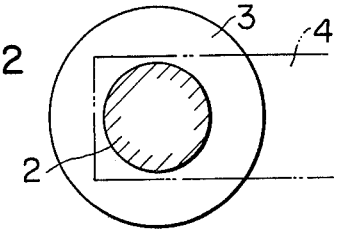
FIG. 2 is a model diagram showing the location of discharge at the center electrode in the spark plug of FIG. 1.

With the thus constructed prior art spark plug, when the high voltage generated by the known ignition coil of the current interruption type is applied to the center electrode 2 so as to produce a discharge, the discharge tends to start at the edge portion of the center electrode 2 and consequently the path for the discharge to develop and travel tends to be directed from the edge portion (the side) of the center electrode 2 toward the ground electrode 4 or its hatched portion as shown in FIG. 2. In addition, the hatched location of discharge irregularly changes each time. As a result, the manner in which the air-fuel mixture is ignited and the resulting flame spreads varies in dependece on the path of discharge.

Figure 3A:
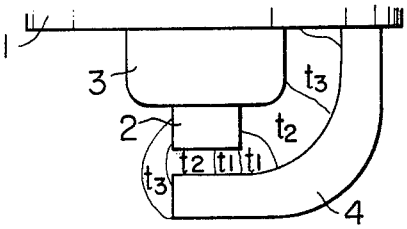
FIGS. 3A, 3B, 3C and 3D are model diagrams showing the manner of development of a flame core depending on different discharge paths of the spark plug shown in FIG. 1.
Figure 3B:
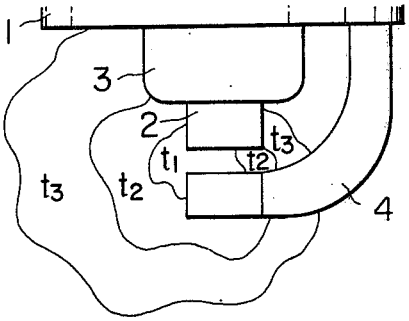
Figure 3E:
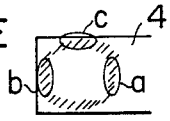
FIG. 3E shows the respective locations of discharge paths on the ground electrode.
Figure 3C:
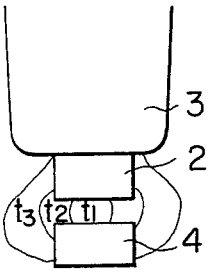
Figure 3D:
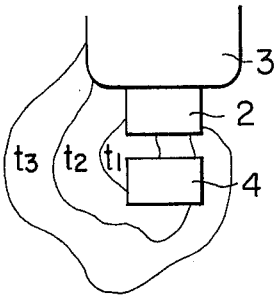

FIGS. 3A, 3B, 3C and 3D show the results of the observations by the photographed combustions on the manner of flame spread according to different paths of discharge. FIG. 3E shows respective locations of discharge paths on the ground electrode. In the Figures, symbols $t_1$, $t_2$ and $t_3$ show the respective flame fronts at intervals of a fixed time from the time of the ignition. FIG. 3A shows the case in which the discharge path is directed toward the backward part of the ground electrode 4 or the hatched portion a in FIG. 3E, so that the flame spreads along the ground electrode 4 which in turn prevents the spreading of the flame and also absorbs the heat of the flame, and consequently the growth of the flame is slow. On the contrary, in FIG. 3B the discharge path is directed to the front side of the ground electrode 4 or the hatched portion b of FIG. 3E, so that since there is no obstacle to the left side of the discharge, the flame tends to spread easily and the rate of combustion in the engine is extremely high as compared with the case of FIG. 3A. Referring to FIGS. 3C and 3D showing left side views of FIG. 3A, in FIG. 3C the discharge path is the same hatched portion a as in FIG. 3E and in FIG. 3D the discharge path is the hatched portion c of FIG. 3E causing the discharge at the end of the ground electrode 4. It will be apparent that in the case of FIG. 3D the flame spreads faster than in the other cases. While the combustion takes place in any of these experimental cases, under unfavorable conditions, such as, at low engine temperatures, low engine speeds, retarded ignition timing or the like where the mixture is not atomized satisfactorily and the flow velocity of the mixture is low, even if the mixture is ignited, the flame will be extinguished midway due to the obstruction and cooling by the ground electrode 4.

Thus, in the case of the known spark plug, the manner in which the flame spreads varies in dependence on the location of discharge and this results in variation of the combustion. In addition, under unfavorable engine conditions the engine will cause misfire and also deteriorated engine feeling and heat-melting loss of the exhaust emission controlling catalyst will be caused.

Figure 4A:
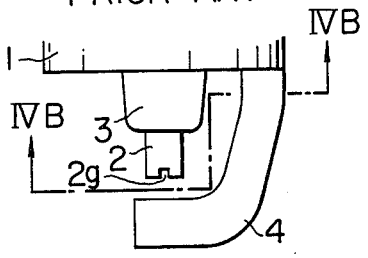
FIG. 4A PRIOR ART
FIG. 4A is a front view showing a principal part of another prior art spark plug.
Figure 4B:
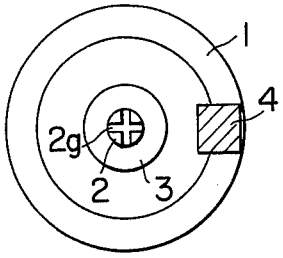
FIG. 4B PRIOR ART
FIG. 4B is a sectional view taken along the line IV-B—IVB of the spark plug of FIG. 4A.
Figure 5:
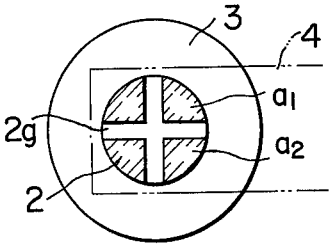
FIG. 5 is a model diagram showing the locations of discharge at the center electrode in the prior art spark plug shown in FIG. 4.

On the other hand, another type of spark plug is known in the prior art in which the center electrode 2 is formed with a cross-shaped groove *2g* in its discharging end face as shown in FIGS. 4A and 4B. Due to the provision of the cross-shaped groove *2g* in the center electrode 2, this spark plug has the effect of decreasing the required voltage and also reducing the contact area between the center electrode 2 and the flame core ignited by the discharge, so that while the cooling effect is reduced with the resulting some improvement in the ignition performance, the location of discharge becomes the hatched portions of FIG. 5 and if the discharge takes place at these hatched portions $a_1$ and $a_2$, the resulting improvement in the ignition performance of the spark plug on the whole will not be quite satisfactory due to the cooling effect in the lengthwise direction of the ground electrode 4 as described in connection with FIG. 3A.

On the other hand, another method is conceivable in which the opposing portions of the ground and center electrodes are formed into needle shape so as to reduce the cooling effect of the electrode as far as possible. However, this method is disadvantageous in that the electrodes will be consumed with the lapse of the engine operation time so that the discharge gap will be widened with the resulting increase in the dielectric breakdown voltage and eventually the discharge will no longer be produced.

DESCRIPTION OF THE PREFERRED EMBODIMENTS

The present invention will now be described in greater detail with reference to the illustrated embodiments.

Figure 6:
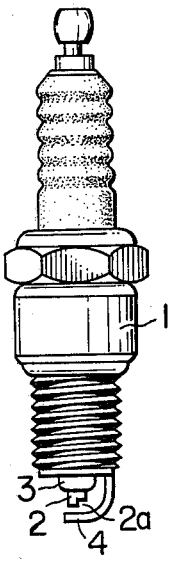
FIG. 6 is a general view of a spark plug according to a first embodiment of the invention.
Figure 7A:
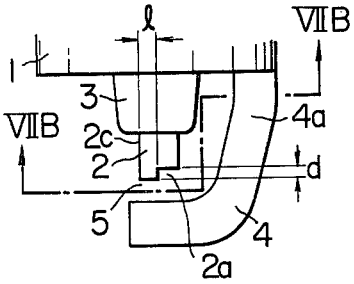
FIG. 7A is an enlarged view showing a principal part of the embodiment shown in FIG. 6.
Figure 7B:
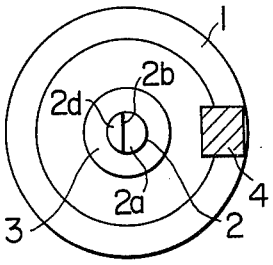
FIG. 7B is a sectional view taken along the line VIIB—VIIB of the principal part of the first embodiment shown in FIG. 7A.

FIG. 6 is a general view showing an embodiment of the present invention. In the Figure, a spark plug according to the invention comprises a metal plug body or shell 1, a center electrode 2, an insulator 3 for insulating the center electrode 2 from the plug shell 1 and a ground electrode 4 fixed to the plug shell 1 and body grounded through the plug shell 1. Referring to FIGS. 7A and 7B illustrating enlarged views of the spark discharge section of the spark plug of the invention shown in FIG. 6, the center electrode 2 includes a cut portion *2a* formed on the forward end thereof as shown in the illustration. The cut portion *2a* extends to a straight line *2b* which is perpendicular to the lengthwise direction of the ground electrode 4, and it is located on the ground electrode bent side of the center electrode 2. Due to the provision of the cut portion *2a*, the discharging face of the center electrode 2 becomes as shown by a reference numeral *2d* and it forms a discharge gap 5. In this case, if the distance between the straight line *2b* and an outer side face *2c* of the center electrode 2 or the length l shown in FIG. 7A is excessively long, it will be impossible to control the intended location of discharge of the spark plug of the invention such that the discharge occurs at any position other than the position a in FIG. 3E. On the other hand, if the length l is excessively short, it will be undesirable from the consumption point of view of the center electrode 2. Thus the length l must be selected so as to overcome these deficiencies. Considering from the consumption point of view of the center electrode 2, the length l should preferably be selected 1 mm or over, and in order to prevent the discharge from occurring at the position a in FIG. 3E the length l should preferably be selected for example less than $\frac{2}{3}$ of the diameter of the center electrode 2. For instance, if the diameter of the center electrode 2 is about 2.4 mm, the length l may be selected from the range of 1.0 to 1.6 mm. On the other hand, the depth d of the cut portion *2a* from the tip of the center electrode 2 should be selected sufficiently large from the standpoint of consumption of the discharging face *2d* due to its burning by the discharge and from the standpoint of preventing discharge on the bent side of the ground electrode 4. For example, the depth d may be selected 0.3 mm or over. While the diameter of the center electrode 2 is selected about 2.4 mm in the above-mentioned case, it may be selected from the range of 1 to 3.2 mm depending on the intended application, and the values of l and d should only be selected in correspondence with the diameter of the center electrode 2. As regards the method of forming the cut portion *2a* of the center electrode 2, any one of various cutting machine tools may be employed to provide the desired cut portion with ease.

Figure 7C:
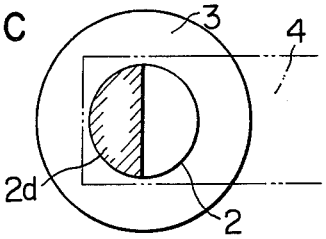
FIG. 7C is a model diagram showing the location of discharge at the center electrode of FIG. 7A.

With the construction described above, the function of the embodiment of the spark plug according to the invention will now be described. When a high voltage is applied to the center electrode 2, the insulation is broken down and a discharge is caused. In this case, while the path for the discharge is dependent on the electric field distribution between the electrodes 2 and 4, the shape of the electrodes 2 and 4, the surface roughness of the electrodes 2 and 4, etc., generally the discharge tends to occur at the electrode edges, and in the case of the present invention the discharge does not occur at the cut portion 2a formed on the center electrode 2 but takes place at the hatched portion in FIG. 7C. In other words, there is no possibility of the discharge occurring at the position a in FIG. 3E as well as at the positions $a_1$ and $a_2$ in FIG. 5. As a result, the flame is prevented from spreading along the lengthwise direction of the ground electrode 4 toward its bend 4a so that the growth of the flame core is not impeded by the ground electrode 4 and the cooling loss of the flame core by the ground electrode 4 is reduced. Consequently, variation in the rate of growth of the flame core is decreased and variation in the combustion is decreased.

Another modified embodiments of the invention will now be described with reference to FIGS. 8 to 16.

Figure 8A:
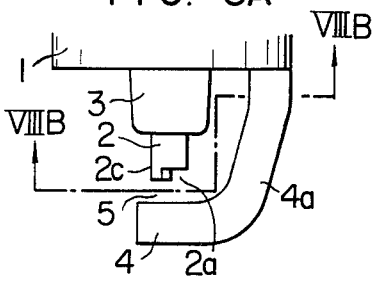
FIGS. 8A and 8B, 9A and 9B, 10A and 10B, 11A and 11B, and 12A and 12B are an enlarged view and a sectional view of a principal part taken along respective one-dot chain line of second to sixth embodiments, respectively, of the spark plug according to the invention.
Figure 8B:
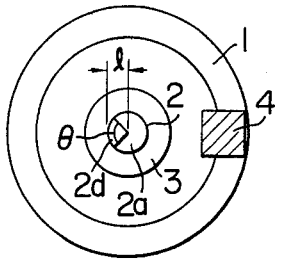

In the second embodiment shown in FIGS. 8A and 8B, the cut portion 2a of the center electrode 2 is formed into an inverted V shape so that the location of discharge is focussed onto the forward end side of the ground electrode 4 and the flame is prevented from growing to spread along the ground electrode 4. In this embodiment, the angle $\theta$ of the V shape of the discharging face 2d left by the cut portion 2a and the distance l from the side face 2c of the center electrode 2 may be suitably selected in relation to each other. For instance, if the diameter of the center electrode 2 is 2.4 mm, it is only necessary to select the angle $\theta$ greater than 60° and the distance l greater than 1 mm.

Figure 9A:
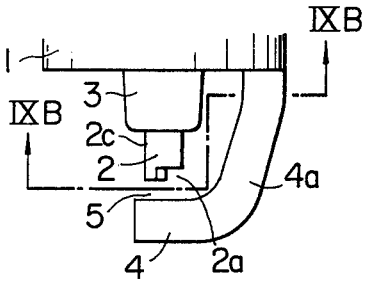
Figure 9B:
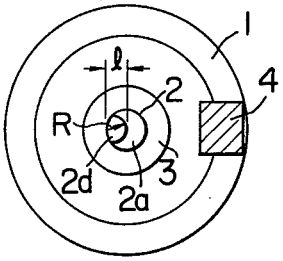

In the third embodiment shown in FIGS. 9A and 9B, the discharging face 2d left by the provision of the cut portion 2a on the center electrode 2 is formed into an arcuate shape, and the radius R of the arcuated portion and the distance l from the side face 2c of the center electrode 2 may be suitably selected in relation to each other. For instance, if the diameter of the center electrode 2 is 2.4 mm, it is only necessary to select the radius R greater than 1 mm and the distance l greater than 1 mm.

Figure 10A:
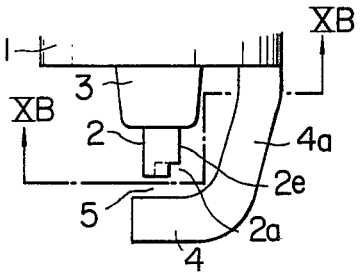
Figure 10B:
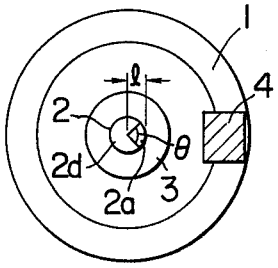

In the fourth embodiment shown in FIGS. 10A and 10B, the cut portion 2a of the center electrode 2 is formed into a V-shape, and the fourth embodiment is considered to be advantageous over the first to third embodiments in terms of durability. The angle $\theta$ of the V-shaped cut portion and the distance l from a side face 2e of the center electrode 2 may be suitably selected in relation to each other. For instance, if the diameter of the center electrode 2 is 2.4 mm, then it is only necessary to select the angle $\theta$ greater than 60° and the distance l greater than 0.8 mm.

Figure 11A:
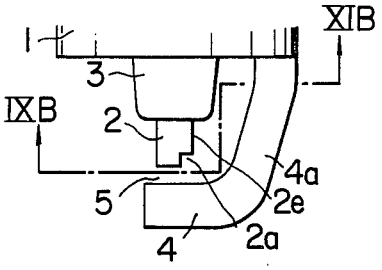
Figure 11B:
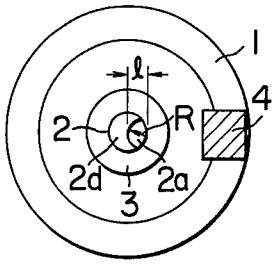

In the fifth embodiment shown in FIGS. 11A and 11B, the cut portion 2a of the center electrode 2 is formed into an arcuate shape, and the radius R of the arcuated portion and the distance l from the side face 2e of the center electrode 2 may be suitably selected in relation to each other. For instance, if the diameter of the center electrode 2 is 2.4 mm, it is only necessary to select the radius R greater than 1 mm and the distance l greater than 0.8 mm.

Figure 12A:
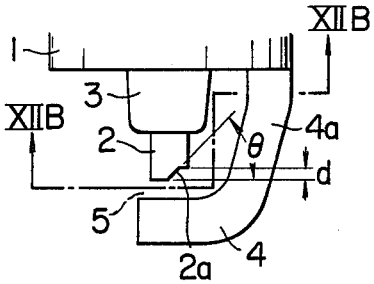
Figure 12B:
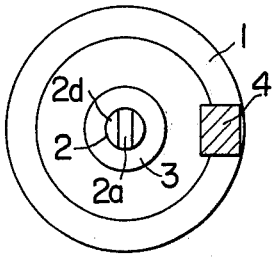

In the sixth embodiment shown in FIGS. 12A and 12B, the surface of the cut portion 2a is inclined with an angle $\theta$ for simplifying the cutting operation as compared with the first embodiment shown in FIGS. 7A and 7B, and the angle $\theta$ may be suitably selected in relation to the diameter of the center electrode 2 and the depth d of the cut portion 2a. In this case, the inclined surface of the cut portion 2a shown in FIG. 12A needs not be a plane surface and it may be a rounded curved surface.

Figure 13A:
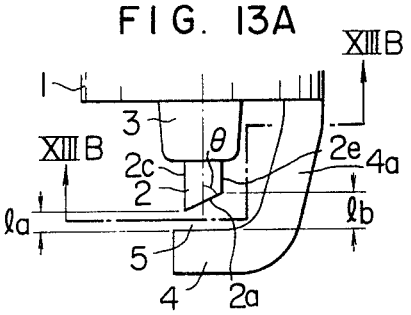
FIGS. 13A and 13B are respectively an enlarged view and XIIIB—XIIIB line sectional view of a principal part of a seventh embodiment of the spark plug according to the invention.
Figure 13B:
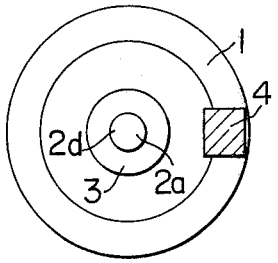
Figure 13C:
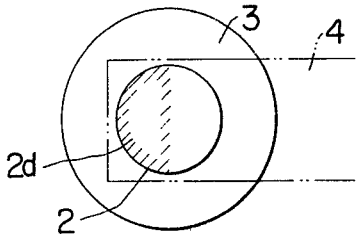
FIG. 13C is a model diagram showing the location of discharge at the center electrode in FIG. 13A.

In the seventh embodiment shown in FIGS. 13A, 13B and 13C, the cut portion 2a of the previously described embodiments is replaced with an inclined portion 2a which is formed so that the distance la between the side face 2c of the center electrode 2 and the ground electrode 4 is shorter than the distance lb between the side face 2e of the center electrode 2 and the ground electrode 4. Due to the provision of the inclined portion 2a on the center electrode 2, the resulting location of discharge becomes the hatched portion of FIG. 13C. In this case, if the angle of inclination $\theta$ of the end face with respect to the axis of the center electrode 2 is selected small, the resulting location of discharge will be confined to a narrow extent with the result that the discharging face 2d of the center electrode 2 is consumed heavily by the discharge and the length of the discharge gap 5 is varied, thus making it impossible to ensure a satisfactory spark plug in terms of durability. On the contrary, if the angle of inclination is increased up to 90°, the location of discharge gradually increases in extent and eventually the discharge takes place even at the position a in FIG. 3E as well as at the positions $a_1$ and $a_2$ in FIG. 5. As a result, in consideration of both the consumption and the location of discharge of the center electrode 2, the angle of inclination $\theta$ must be determined so that the location of discharge becomes the hatched portion in FIG. 13C.

Figure 14A:
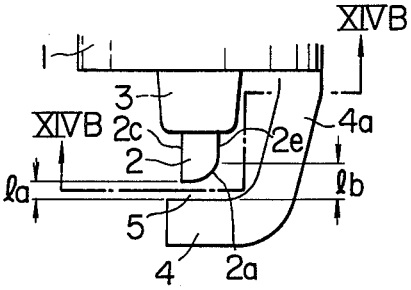
FIGS. 14A and 14B and 15A and 15B are an enlarged view and a sectional view of a principal part taken along respective one-dot chain line of eighth and nineth embodiments, respectively, of the spark plug according to the invention.
Figure 14B:
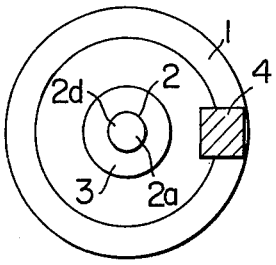

In the eighth embodiment shown in FIGS. 14A and 14B, the inclined portion 2a formed on the forward end face of the center electrode 2 is rounded. As a result, the discharging distance la between the side face 2c of the center electrode 2 and the ground electrode 4 becomes shorter than the discharging distance lb between the side face 2e of the center electrode 2 and the ground electrode 4 and the location of discharge is controlled so that the discharge occurs at around the forward end portion of the ground electrode 4 without fail. Thus the spark plug of this embodiment is also advantageous over the seventh embodiment in terms of durability. In this case, the degree of rounding of the thus provided inclined portion 2a is determined in consideration of both the positive controlling of the discharge location and durability.

Figure 15A:
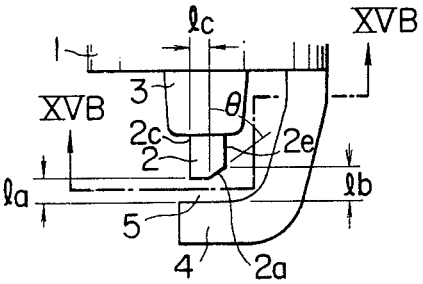
Figure 15B:
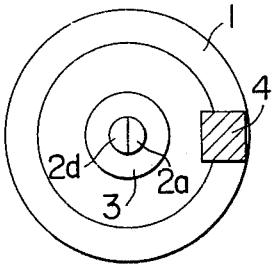

In the ninth embodiment shown in FIGS. 15A and 15B, the inclined portion 2a making the angle $\theta$ with the axis of the center electrode 2 is formed on its forward end face at a distance lc from the side face 2c of the center electrode 2. As a result, the location of discharge becomes a position corresponding to the distance lc from the side face 2c of the center electrode 2 and the discharge is confined to around the forward end of the ground electrode 4, thus making the spark plug advantageous over the seventh embodiment in terms of durability. In this case, the distance lc from the side face 2c of the center electrode 2 to the position at which the inclination begins and the angle of inclination $\theta$ are determined in consideration of both the positive controlling of the discharge location and durability.

The features of the foregoing embodiments of the present invention may be shown by those of the following 1st to 16th spark plugs.

A 1st spark plug for an internal combustion engine having at least one combustion chamber comprising: a center electrode having a discharging forward end face; a ground electrode having a discharging end face, and a bent portion for causing said end face thereof to oppose said forward end face of said center electrode; means for supporting said electrodes such that said discharging end faces oppose each other within said combustion chamber; and discharge control means provided on one side of said discharging forward end face of said center electrode opposing said bent portion for controlling a path of discharge between said discharging end faces. A 2nd spark plug as recited in the 1st plug, wherein said discharge control means includes a cut portion formed on one side of said discharging forward end face of said center electrode opposing said bent portion. A 3rd spark plug as recited in the 2nd plug, wherein said cut portion has substantially a semicircular shape (FIGS. 6 and 7). A 4th spark plug as recited in the 3rd plug, wherein said discharging forward end face of said center electrode has a maximum radial width not less than 1 mm and not greater than two thirds of the diameter of said center electrode. A 5th spark plug as recited in the 3rd or 4th plug, wherein said cut portion is greater than 0.3 mm in depth. A 6th spark plug as recited in the 2nd plug, wherein said cut portion is formed into an inverted V shape, and wherein said discharging forward end face is formed into a sectorial shape (FIG. 8). A 7th spark plug as recited in the 6th plug, wherein said sectorial shape has a radial width greater than 1 mm and has a top angle between 60 and 180 degrees. An 8th spark plug as recited in the 2nd plug, wherein said cut portion is formed into a crescent shape (FIG. 9). A 9th spark plug as recited in the 8th plug, wherein said discharging forward end is formed into a crescent shape having a radial maximum width greater than 1 mm and a radius of curvature greater than 1 mm. A 10th sprak plug as recited in the 2nd plug, wherein said cut portion is formed into a V shape (FIG. 10). A 11th spark plug as recited in the 10th plug, wherein said cut portion has a maximum radial width greater than 0.8 mm, and wherein said V shape has a top angle between 60 and 180 degrees. A 12th spark plug as recited in the 2nd plug, wherein said cut portion forms an arcuate indentation (FIG. 11). A 13th spark plug as recited in the 12th plug, wherein said indentation is greater than 0.8 mm in depth, and wherein the radius of curvature of said arcuate is greater than 1 mm. A 14th spark plug as recited in the 2nd plug, wherein said cut portion is in the form of an inclined face made on one side of said discharging forward end face (FIG. 12 or 15). A 15th spark plug as recited in the 1st plug, wherein said discharge control means includes an inclined face formed at least on one side of said discharging forward end face (FIGS. 13, 14, 15). A 16th spark plug as recited in the 15th plug, wherein said inclined face is in the form of a rounded face (FIG. 14).

It will thus be seen from the foregoing that in accordance with the present invention, by virtue of the fact that the discharging face side of the center electrode is shaped such that the discharge gap is not formed on the side of that center electrode side face opposing the bend of the ground electrode but it is formed on the side of the other center electrode side face, there is a great advantage that the discharge is controlled so as to be confined to around the forward end portion of the ground electrode, with the result that the flame is prevented from growing along the ground electrode toward its bend, thus decreasing the cooling loss of the flame core by the ground electrode and minimizing the obstruction to the flame propagation by the ground electrode and thereby improving the ignition performance and reducing variation in the combustion. Another great advantage of the invention is that the above-mentioned effects can be realized by simply modifying the shape of the center electrode and consequently there is a very great merit in terms of cost as compared with the case where the ignition performance is improved by modifying the ignition power source or the engine body.

What is claimed is:

1. A spark plug for an internal combustion engine having at least one combustion chamber comprising:

a center electrode having a discharging forward end face;

a ground electrode having a discharging end face, a free end portion and a bent portion for causing said end face thereof to oppose said forward end face of said center electrode and to position the free end portion on the opposite side of said center electrode from that, adjacent which the bent portion lies;

means for supporting said electrodes such that said discharging end faces oppose each other within said combustion chamber; and wherein a predetermined portion of the end face of said center electrode projects toward the discharging end face of said ground electrode so as to form a discharge gap between the center and ground electrodes adjacent the free end of said ground electrode and the side of the center electrode remote from the bent portion of said ground electrode.

2. A spark plug according to claim 1, wherein the projecting portion of said center electrode is defined by a cut portion formed on one side of said discharging forward end face of said center electrode opposing said bent portion.

3. A spark plug according to claim 2, wherein said cut portion has substantially a semicircular shape.

4. A spark plug according to claim 3, wherein said discharging forward end face of said center electrode has a maximum radial width not less than 1 mm and not greater than two thirds of the diameter of said center electrode.

5. A spark plug according to claim 3 or 4, wherein said cut portion is greater than 0.3 mm in depth.

6. A spark plug according to claim 2, wherein said cut portion is formed into an inverted V shape, and wherein said discharging forward end face is formed into a sectorial shape.

7. A spark plug according to claim 6, wherein said sectorial shape has a radial width greater than 1 mm and has a top angle between 60 and 180 degrees.

8. A spark plug according to claim 2, wherein said cut portion is formed into a crescent shape.

9. A spark plug according to claim 8, wherein said discharging forward end is formed into a crescent shape having a radial maximum width greater than 1 mm and a radius of curvature greater than 1 mm.

10. A spark plug according to claim 2, wherein said cut portion is formed into a V shape.

11. A spark plug according to claim 10, wherein said cut portion has a maximum radial width greater than 0.8 mm, and wherein said V shape has a top angle between 60 and 180 degrees.

12. A spark plug according to claim 2, wherein said cut portion forms an arcuate indentation.

13. A spark plug according to claim 12, wherein said indentation is greater than 0.8 mm in depth, and wherein the radius of curvature of said arcuate is greater than 1 mm.

14. A spark plug according to claim 2, wherein said cut portion is in the form of an inclined face made on one side of said discharging forward end face.

15. A spark plug according to claim 1, wherein the projecting portion of said center electrode includes an inclined face formed at least on one side of said discharging forward end face.

16. A spark plug according to claim 15, wherein said inclined face is in the form of a rounded face.

* * * * *